US009596740B2

(12) United States Patent
Pearson et al.

(10) Patent No.: US 9,596,740 B2
(45) **Date of Patent: *Mar. 14, 2017**

(54) LED AUDITORIUM HOUSE LIGHT SYSTEM

(71) Applicant: Tempo Industries, LLC, Irvine, CA (US)

(72) Inventors: Dennis Pearson, Foothill Ranch, CA (US); Michael D. Bremser, Seal Beach, CA (US)

(73) Assignee: Tempo Industries, LLC, Irvine, CA (US)

( * ) Notice: Subject to any disclaimer, the term of this patent is extended or adjusted under 35 U.S.C. 154(b) by 156 days.

This patent is subject to a terminal disclaimer.

(21) Appl. No.: 14/445,609

(22) Filed: Jul. 29, 2014

(65) Prior Publication Data

US 2016/0014869 A1 Jan. 14, 2016

Related U.S. Application Data

(63) Continuation-in-part of application No. 14/330,409, filed on Jul. 14, 2014.

(51) Int. Cl.
*F21S 8/00* (2006.01)
*H05B 37/02* (2006.01)
(Continued)

(52) U.S. Cl.
CPC ..... *H05B 37/029* (2013.01); *F21S 2/005* (2013.01); *F21S 8/026* (2013.01); *F21S 8/046* (2013.01);
(Continued)

(58) Field of Classification Search
CPC . F21S 2/005; F21S 8/026; F21S 8/046; F21V 23/04; F21W 2131/406;
(Continued)

(56) References Cited

U.S. PATENT DOCUMENTS 3,030,670 A 4/1962 Bigelow
5,620,369 A 4/1997 Spransy et al.
(Continued)

FOREIGN PATENT DOCUMENTS

DE 102009016753 A1 10/2010
DE 102010001777 A1 8/2011
(Continued)

OTHER PUBLICATIONS

EPO 15159756.4 extended European search report, Apr. 12, 2015.

*Primary Examiner* — Peggy Neils
(74) *Attorney, Agent, or Firm* — Lapple Ubell IP Law, LLP; Franklin Ubell

(57) ABSTRACT

A plurality of LED light fixtures are mounted in a ceiling of an auditorium and a power control system is positioned in an area separate from a seating area of the auditorium for supplying power to the LED light fixtures. Each LED light fixture comprises an extrusion carrying one or more ambience light LED modules for providing ambient light and one or more high intensity LED modules for providing full level lighting. The power control system is configured to collectively switch the ambience light LED modules "on" and "off" and to separately and collectively switch the high intensity LED modules "on" and "off" to thereby provide either low level ambient light or high intensity full level lighting to the auditorium.

19 Claims, 4 Drawing Sheets

(51) Int. Cl.

| | |
|---|---|
| ***F21S 2/00*** | (2016.01) |
| ***F21S 8/02*** | (2006.01) |
| ***F21S 8/04*** | (2006.01) |
| ***F21V 23/04*** | (2006.01) |
| ***H05B 33/08*** | (2006.01) |
| ***F21V 23/02*** | (2006.01) |
| *F21W 131/406* | (2006.01) |
| *F21Y 101/00* | (2016.01) |

(52) U.S. Cl.
CPC ..... *F21V 23/02* (2013.01); *F21V 23/04* (2013.01); *H05B 33/0845* (2013.01); *F21W 2131/406* (2013.01); *F21Y 2101/00* (2013.01); *F21Y 2103/10* (2016.08); *F21Y 2115/10* (2016.08)

(58) Field of Classification Search
CPC ..... F21Y 2101/02; F21Y 2103/003; H05B 33/0845; H05B 37/029
See application file for complete search history.

(56) References Cited

U.S. PATENT DOCUMENTS

| | | | | |
|---|---|---|---|---|
| 6,351,920 | B1 | 3/2002 | Hopkins et al. | |
| 7,353,071 | B2 | 4/2008 | Blackwell et al. | |
| 7,405,715 | B2 | 7/2008 | Guzman et al. | |
| 7,686,642 | B2 | 3/2010 | Pearson et al. | |
| 7,726,840 | B2 | 6/2010 | Pearson et al. | |
| 7,798,841 | B2 | 9/2010 | Pearson et al. | |
| 8,002,426 | B2 | 8/2011 | Pearson et al. | |
| 8,061,870 | B2 | 11/2011 | Pearson et al. | |
| 8,177,385 | B2 | 5/2012 | Porciatti | |
| 8,398,276 | B2 | 3/2013 | Pearson et al. | |
| 8,672,508 | B2 | 3/2014 | Pearson et al. | |
| 8,742,694 | B2 | 6/2014 | Bora et al. | |
| 8,860,326 | B2 * | 10/2014 | Cahalane | H05B 33/0845 315/185 R |
| 9,217,247 | B2 | 12/2015 | Behling et al. | |
| 2006/0238136 | A1 | 10/2006 | Johnson, III et al. | |
| 2010/0259931 | A1 | 10/2010 | Chemel et al. | |
| 2012/0051041 | A1 | 3/2012 | Edmond et al. | |
| 2012/0063138 | A1 | 3/2012 | Leadford et al. | |
| 2012/0091903 | A1 | 4/2012 | Bembridge et al. | |
| 2012/0235579 | A1 * | 9/2012 | Chemel | F21S 2/005 315/152 |
| 2012/0280637 | A1 | 11/2012 | Tikkanen et al. | |
| 2013/0021792 | A1 | 1/2013 | Snell et al. | |
| 2013/0039066 | A1 | 2/2013 | Porciatti | |
| 2013/0070461 | A1 | 3/2013 | Pickard | |
| 2013/0176722 | A1 | 7/2013 | Lay et al. | |
| 2013/0208457 | A1 | 8/2013 | Durkee et al. | |
| 2013/0208469 | A1 | 8/2013 | Progl | |
| 2013/0249405 | A1 | 9/2013 | Cahalane et al. | |
| 2013/0250567 | A1 | 9/2013 | Edmond et al. | |
| 2013/0265764 | A1 | 10/2013 | Holman et al. | |
| 2013/0271979 | A1 | 10/2013 | Pearson et al. | |
| 2013/0272000 | A1 | 10/2013 | Pearson et al. | |
| 2013/0279165 | A1 | 10/2013 | Pearson et al. | |
| 2013/0279179 | A1 | 10/2013 | Pearson et al. | |
| 2013/0279180 | A1 | 10/2013 | Pearson et al. | |
| 2015/0016106 | A1 * | 1/2015 | Belliveau | F21V 14/02 362/233 |

FOREIGN PATENT DOCUMENTS

| | | | |
|---|---|---|---|
| WO | 2011139764 | A2 | 11/2011 |
| WO | 2012129243 | A1 | 9/2012 |

* cited by examiner

LED AUDITORIUM HOUSE LIGHT SYSTEM

CROSS REFERENCE TO RELATED APPLICATIONS

The subject application is a continuation-in-part of and claims priority to U.S. patent application Ser. No. 14/330,409 filed Jul. 14, 2014, the contents of which is incorporated herein by this reference in its entirety.

BACKGROUND OF THE DISCLOSURE

Field of the Disclosure

The subject disclosure relates to electrical lighting systems and more particularly to a lighting system employing LED light fixtures to illuminate an auditorium or similar venue.

Related Art

Incandescent lighting systems for illuminating theatres, auditoriums and the like have been used in the past.

SUMMARY

An illustrative auditorium lighting system embodiment comprises a plurality of LED light fixtures mounted in a ceiling of an auditorium, each fixture including a plurality of LED modules. In one embodiment, a power control system for supplying power to the LED modules is positioned in an area separate from the seating area of the auditorium.

In one embodiment, each LED light fixture includes an extrusion which carries a plurality of LED modules including one or more ambience light LED modules for providing ambient light and one or more high intensity LED modules for providing full level lighting. In one embodiment, the high intensity light provided by the high intensity LED modules is achieved by employing high output LED's (>100 Lumens each) in combination with optics producing a light beam having a full width half maximum angle of 12 degrees or 35 degrees.

In one embodiment, the power control system is configured to collectively switch the one or more ambience light LED modules "on" and "off" and to separately and collectively switch the one or more high intensity LED modules "on" and "off" to thereby selectively provide either low level ambient light or high intensity full level lighting to the auditorium. The power control system may further provide dimming of all or selected ones of the modules by means of phase or low voltage dimming.

In one embodiment, the low level lighting is used during intermission periods and the high intensity lighting is used during cleaning periods.

DETAILED DESCRIPTION

Figure 1:
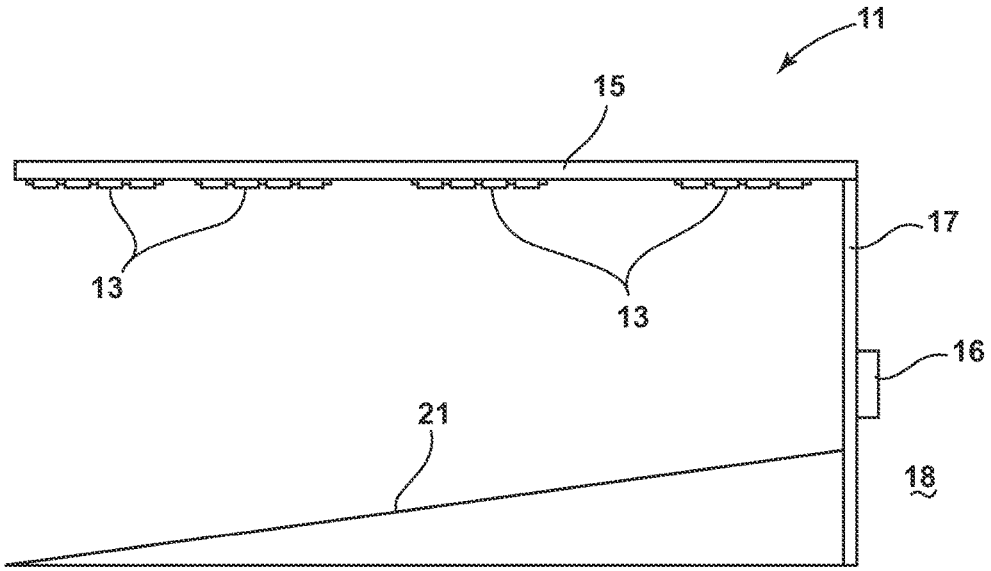
FIG. 1 is a side schematic view illustrating an auditorium lighting system according to an illustrative embodiment.
Figure 2:
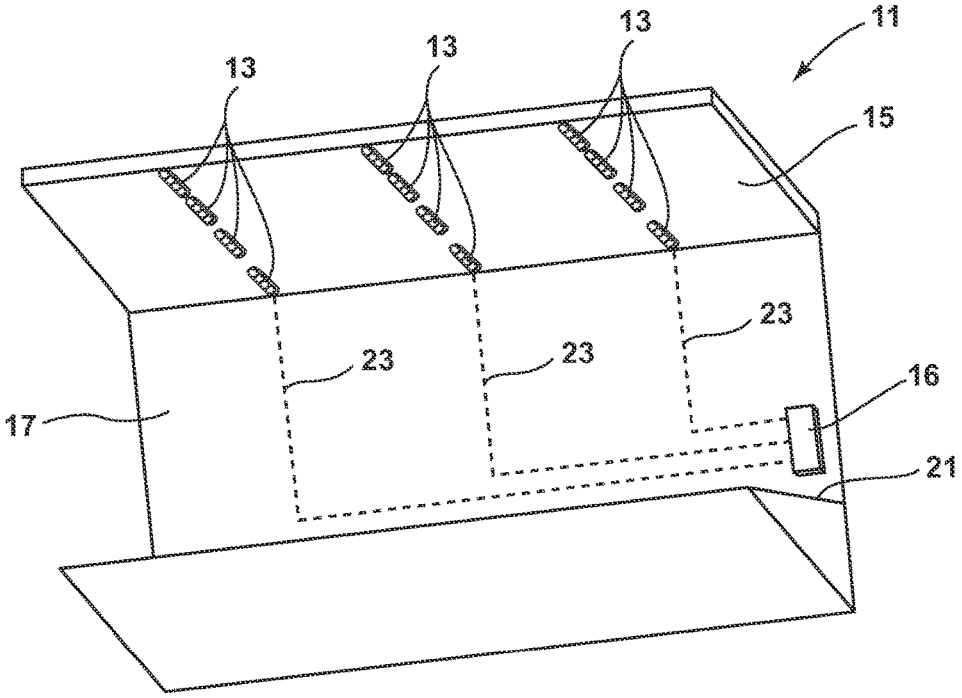
FIG. 2 is a perspective view of the lighting system of FIG. 1.

An auditorium lighting system 11 according to an illustrative embodiment is shown in FIGS. 1 and 2. It should be understood that as used here, the term "auditorium" encompasses theaters such as conventional "movie" theaters.

The lighting system 11 employs a plurality of light fixtures 13 installed in or attached to a ceiling 15 above a floor 21. These light fixtures 13 can be installed at regular or irregular spacing intervals so as to achieve uniform illumination of the floor 21, which typically slopes downwardly in a multi-level, "stadium style" arrangement and on which a number of seats are positioned, typically separated by one or more aisles. In other applications, the floor 21 may be flat.

A junction box 16 containing a plurality of LED drivers, for example, three drivers, is shown attached to the front interior wall 17 of a projection booth 18. The junction box 16 may be positioned elsewhere in the projection booth 18 in various embodiments or in another easy-to-access location, such as, for example, above a T-bar grid at the cross aisles. The junction box 16 may include controls, dimmers, surge protection, emergency back-up equipment and supplies electrical power to the light fixtures 13, as well as dimming capability.

FIG. 2 schematically illustrates the power feeds 23 to the fixtures 13 from the junction box 16 as three dashed lines. Remote positioning of the power system as illustrated in FIGS. 1 and 2 makes wiring, dimming, and maintenance easier to manage.

Figure 3:
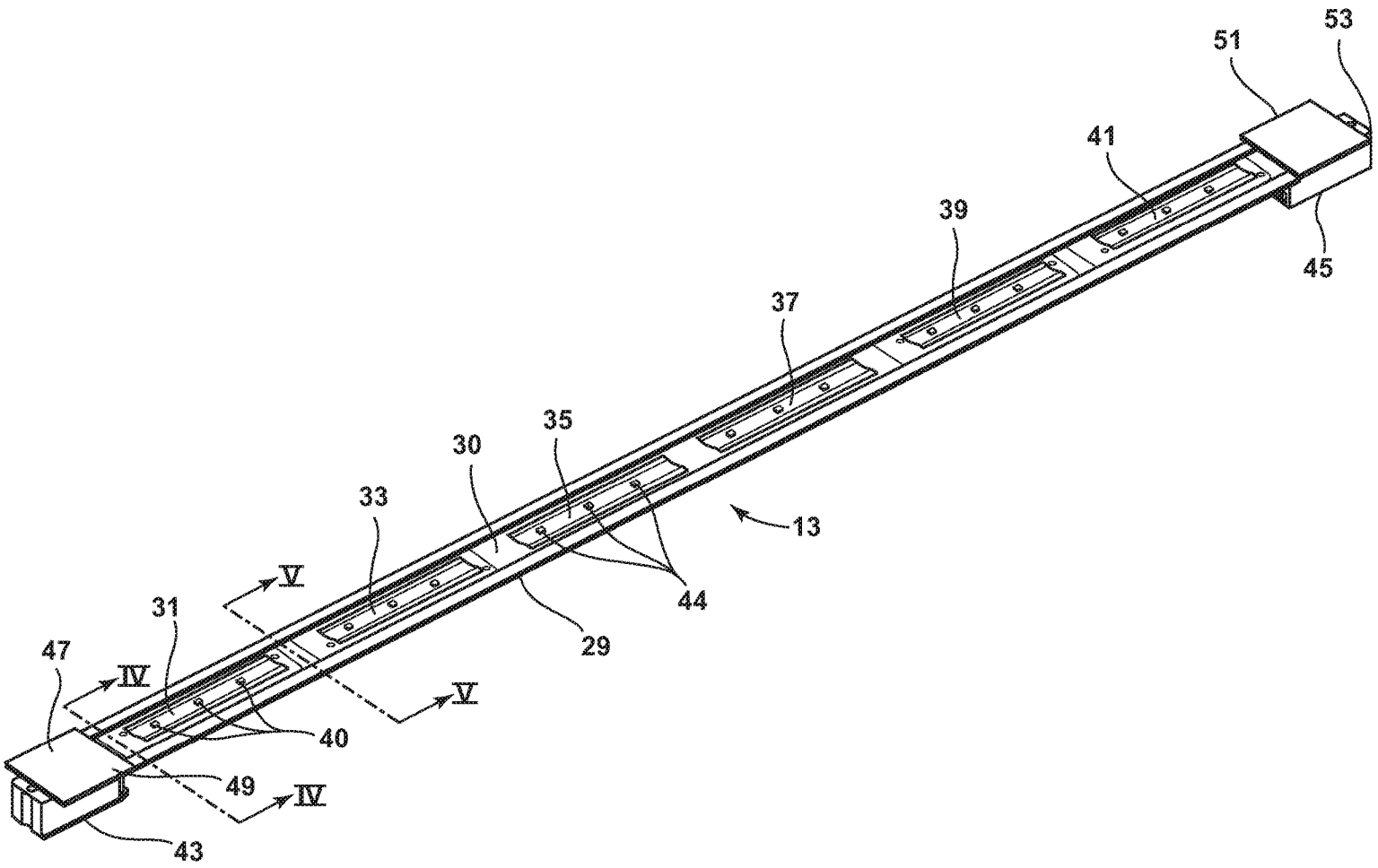
FIG. 3 is a perspective view of a lighting fixture employable in the system of FIG. 2.
Figure 6:
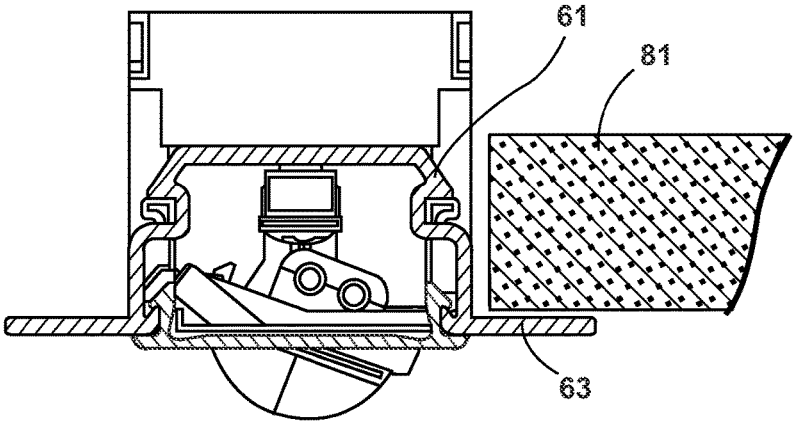
FIG. 6 is a detail view illustrating cooperation of the fixture of FIG. 3 with adjacent sealing tile.

An illustrative light fixture 13 is shown in FIG. 3. The fixture 13 includes an elongated extrusion 29, which provides a mounting surface or surfaces 30 for a plurality of LED modules 31, 33, 35, 37, 39, 41. The extrusion 29 further has respective junction boxes 43, 45 and horizontal flanges 47, 49; 51, 53 at each end. The junction or "splice" boxes 43, 45 provide faster and easier wiring, while the flanges 47, 49; 51, 53 assist in mounting the fixtures 13 to cooperate with adjacent ceiling tile. FIG. 6 illustrates the manner in which the flanges 47, 49; 51, 53 accommodate ceiling tile 81 in one illustrative embodiment.

Figure 4:
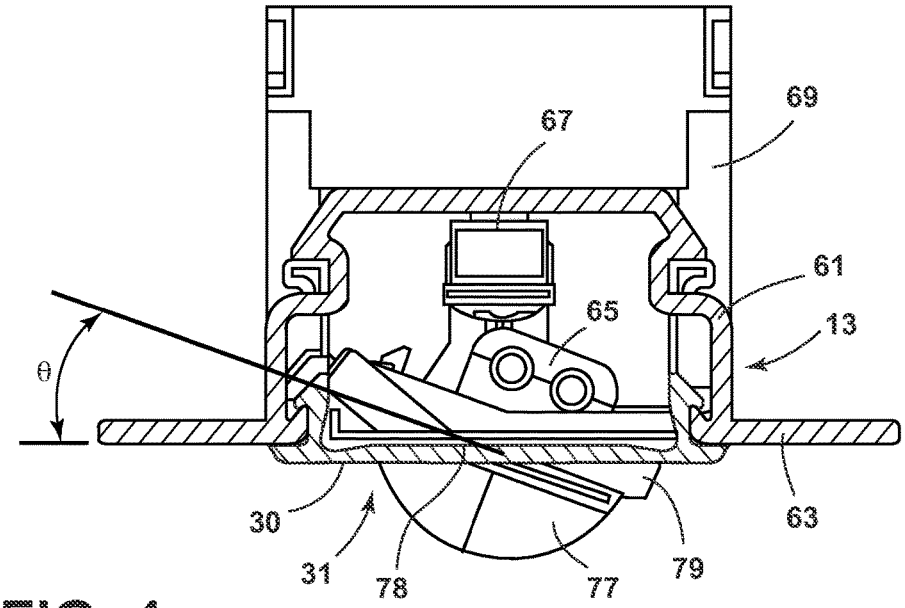
FIG. 4 is a first cross-sectional view of the fixture taken at IV-IV of FIG. 3.
Figure 5:
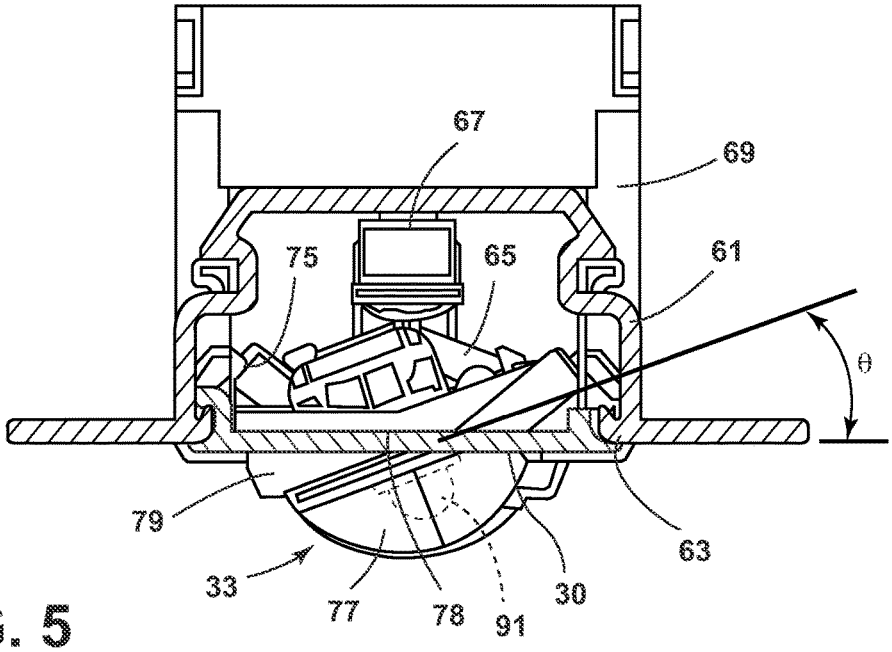
FIG. 5 is a second cross-sectional view of the fixture taken at V-V of FIG. 3.

In an illustrative embodiment, the pairs of LED modules 31, 33; 39, 41 at opposite ends of the extrusion 13 are high intensity modules, which provide light for periods of cleaning or other maintenance. As illustrated in FIGS. 4 and 5, in one embodiment, the lighting system 11 employs high intensity modules, e.g., 31, 33 which are angled to the horizontal at an acute angle θ of, for example, 20° (degrees) and are aimed in opposing directions in order to increase the spread of light, thereby necessitating fewer fixtures in some embodiments. In addition, lenses or optics, e.g., 91, are employed in each high intensity module 31, 33 to produce a relatively intense light beam having, for example, a full width half maximum angle of 12 degrees.

Additionally, in the illustrative embodiment, the center LED modules 35, 37 are ambient lighting modules configured to provide ambient light to illuminate the theater or auditorium, for example, during intermission periods. Other componentry shown in FIGS. 4 and 5 includes the fixture housing extrusion 61, a bottom cover 78, a printed circuit board assembly ("PCBA") carrier 79, a PCBA carrier retention screw 75, a plastic dome lens 77, splice box 69 and splice box retention tab 67, electrical connector body 65, and ceiling tile flange 63. In one embodiment, the extrusion 61 may be an aluminum extrusion and the bottom cover 78 may be die cast aluminum. In one embodiment, the extrusion 61 and bottom cover 78 may be constructed as illustrated in U.S. Patent Publication 2013/0279180 A1 published Oct. 24, 2013, the contents of which are incorporated in their entirety herein.

In one embodiment, each LED module 31, 33, 35, 37, 39, 41, may comprise a circuit board with one or more LED emitters mounted thereon. In one embodiment, the high intensity modules 31, 33; 39, 41 employ three emitters e.g. 40, while the ambience modules 35, 37 employ eleven emitters, e.g. 44. In one embodiment, each emitter 44 of the ambience modules 35, 37 may have an output of 40 lumens at a full width half maximum angle of 120°.

In one embodiment, the LED modules 31, 33, 35, 37, 39, 41 are configured in pairs and each may be six inches in length positioned in an extrusion 29 which is 42 inches in length, together with two splice boxes 69, resulting in a total fixture length of 47¾". Another embodiment may employ an eighteen inch long extrusion having three LED modules, together with two splice boxes 69, resulting in a total fixture length of 23¾". For example, such an embodiment may employ one central ambience LED module, flanked on either side by a high intensity LED module where the high intensity LED modules are angled at 20 degrees to the horizontal and oppositely directed. In one embodiment, the relatively dim ambient intermission lighting may provide 2-4 foot candles of total light, while the full level, high intensity "cleaning" light modules may provide 6-9 foot candles of total light. In various embodiments, the light delivered by the modules may be adjusted based upon the ceiling height at the location where a particular fixture 13 is positioned.

In one embodiment, the ambience modules 35, 37 may be collectively switched "on" or "off" at the same time, and the high intensity modules 31, 33; 39, 41 may also be collectively switched "on" or "off" at the same time. When the high intensity modules are collectively switched "on", each module 31, 33, 39, 41 is powered "on" and provides high intensity illumination. Similarly, when the ambience modules 35, 37 are collectively switched "on", each ambience modules 35, 37 is powered "on" and provides ambient illumination. In one embodiment, the ambience module 35, 37 are collectively switched or turned "on", while the high intensity modules 31, 33; 39, 41 are held or switched "off" and vice versa. In a dark state of the auditorium, all of the modules 31, 33, 35, 37, 39, 41 are in the "off" state.

Figure 7:
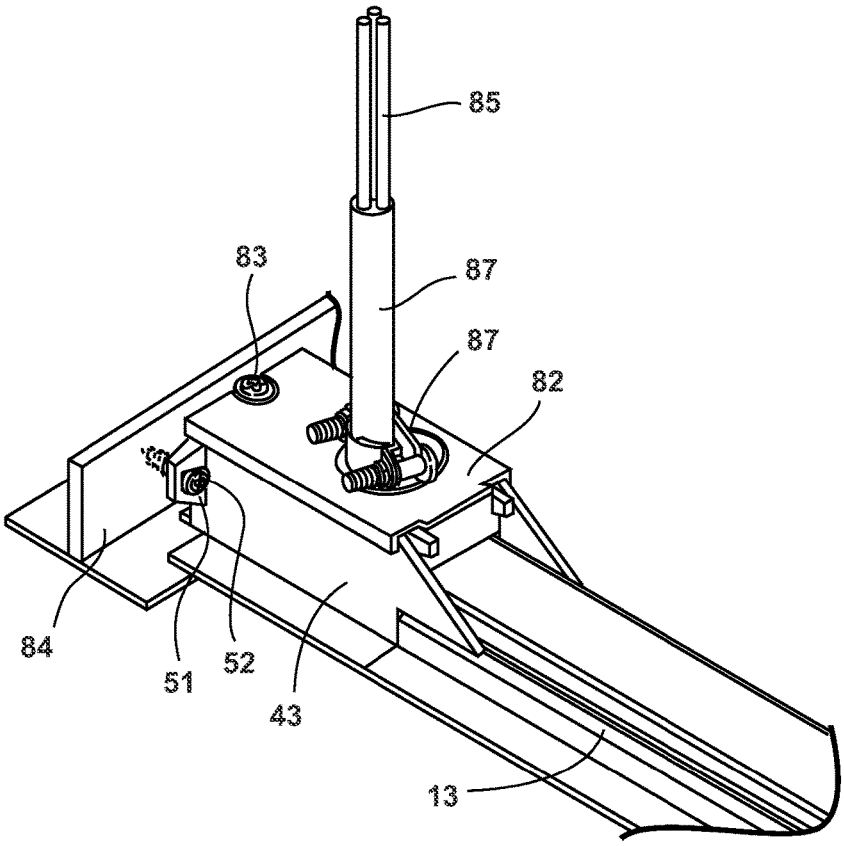
FIG. 7 is a perspective end view showing an illustrative installation of the fixture of FIG. 3.

FIG. 7 illustrates an attachment eyelet 51 on splice box 43 for attaching a fixture 13 by fasteners, e.g. 52, to a cooperating ceiling grid structure 84. Fixtures 13 may also be suspended by wires which terminate at structural elements of the building above the ceiling grid or by other mechanisms. FIG. 7 further illustrates electrical power cable 85 and cable sheath 87 held in place by a clamp 87. In one embodiment, two-circuit wiring is provided to enable individual on-off and dimming control of the high intensity modules 31, 33; 39, 41 and the ambient lighting modules 35, 37. In one embodiment, the junction boxes 43, 45 permit lead wires from the power supply to be connected by simply "poking" them in, and one fixture can be readily electrically interconnected to the next ("daisy chained"). After electrical connections are made, splice box lids, e.g. 82, are put in place and secured to the splice box, e.g. 43, by fasteners, e.g. 83. Low voltage or line voltage embodiments can be constructed in accordance with the above teachings.

Thus, those skilled in the art will appreciate that various adaptations and modifications of the just described preferred embodiment can be configured without departing from the scope and spirit of the invention. Therefore, it is to be understood that, within the scope of the appended claims, the invention may be practiced other than as specifically described herein.

What is claimed is:

1. A method of lighting an auditorium comprising:

installing a lighting system in the auditorium, the lighting system comprising:

a plurality of LED light fixtures, each said LED light fixture comprising a fixture body comprising a plurality of LED modules; and a power control system;

wherein the plurality of LED modules of each respective LED light fixture comprise:

one or more high intensity light LED modules each configured to provide light of a level selected for use during a cleaning period of the auditorium; and one or more ambience light LED modules each configured to provide light of a level selected for use during an intermission period in the auditorium;

the method further comprising:

collectively switching each of the one or more ambience light LED modules of each of the LED light fixtures "on" while said one or more high intensity light LED modules of each of the LED light fixtures is in an "off" state so as to illuminate said auditorium during an intermission period; and separately and collectively switching each of the one or more high intensity light LED modules of each of the plurality of LED light fixtures "on" while each of the one or more ambience light LED modules of each of the plurality of LED light fixtures is in an "off" state so as to illuminate said auditorium during a cleaning period.

2. LED auditorium lighting apparatus comprising:

a plurality of LED modules comprising:

one or more high intensity light LED modules each configured to provide light of a level selected for use during cleaning periods of the auditorium; and one or more ambience light LED modules each configured to provide light of a level selected for use during intermission periods in said auditorium;

wherein each ambient light LED module comprises a circuit board mounting a plurality of LEDs and wherein each high intensity light LED module comprises a circuit board mounting a plurality of LEDs and wherein each high intensity LED module and each ambience light LED module are arranged linearly in the same row with their respective LEDs positioned to direct light into said auditorium;

a power control system configured to collectively switch each of the one or more ambience light LED modules "on" and "off" and to separately and collectively switch each of the one or more high intensity light LED modules "on" and "off", whereby the apparatus is enabled to respectively provide either light of a level selected for use during intermission periods or light of a level selected for use during cleaning periods of the auditorium; and wherein said power control system comprises a plurality of LED drivers configured to drive each of the plurality of LED modules.

3. A motion picture theater lighting system comprising:

a plurality of LED light fixtures positioned adjacent a ceiling of the theater to provide light to the theater, each of the plurality of LED light fixtures comprising a plurality of LED modules disposed in a linear row;

one or more of the LED modules in the linear row of each of the plurality of LED light fixtures being a high intensity light LED module configured to provide light of a level selected for use during cleaning periods of the theater;

one or more of the LED modules disposed in the linear row of each of the plurality of LED light fixtures being an ambience light LED module configured to provide light of a level selected for use during intermission periods in the theater; and a power control system located in a projection booth of the theater and comprising a plurality of LED drivers configured to drive each of the plurality of LED modules of each of said plurality of LED light fixtures, the power control system in the projection booth being configured to:

(a) turn on all of the ambience light LED modules of each of the plurality of LED light fixtures while all of the high intensity light LED modules are off so as to provide a level of light selected for use during an intermission period in the theater;

(b) turn on all of the high intensity light LED modules of each of the plurality of LED light fixtures while all of the ambience light LED modules of each of the plurality of LED light fixtures are off so as to provide a level of light selected for use during a cleaning period in the theater; and (c) provide an "off" state of each of the LED modules of each of the plurality of LED light fixtures so as to establish a dark state in the theater.

4. The motion picture theater lighting system of claim 3 wherein the number of LED light fixtures and number of LED light modules are configured to provide sufficient illumination of the theater in the three states: intermission ambient lighting, full level light cleaning and dark state.

5. The motion picture theater lighting system of claim 4 wherein the LED light modules of the LED light fixtures provide 6-9 foot candles of light in the cleaning state and 2-4 foot candles of light in the ambient light intermission state.

6. The method of lighting an auditorium of claim 1 further comprising employing a plurality of LED drivers of said power control system to collectively switch on and off each of the ambience light LED modules and each of the high intensity light LED modules.

7. The auditorium lighting system of claim 2, wherein at least one of said one or more ambience light LED modules is configured to be dimmable.

8. The auditorium lighting system of claim 2, wherein at least one of said one or more high intensity light LED modules is configured to be dimmable.

9. The auditorium lighting system of claim 7, wherein at least one of said one or more high intensity light LED modules is configured to be dimmable.

10. The auditorium lighting system of claim 2, wherein a pair of said high intensity light LED modules are angled so as to direct light in opposite directions.

11. The auditorium lighting system of claim 10, wherein the first of said high intensity light LED modules directs light downwardly at an angle of 20 degrees to the horizontal; while the second of said high intensity light LED modules directs light downwardly at an angle of 20 degrees to the horizontal in a direction opposite to that at which said first high intensity light LED module directs light.

12. The auditorium lighting system of claim 2, wherein one or more of said high intensity light LED modules is configured to produce a light beam having a full width half maximum angle in the range of 12 to 35 degrees.

13. The auditorium lighting system of claim 2, wherein said ambience light LED modules provide 2 to 4 foot candles of light and said high intensity light LED modules provide 6 to 9 foot candles of light.

14. The auditorium lighting system of claim 12, wherein said ambience light LED modules provide 2 to 4 foot candles of light and said high intensity light LED modules provide 6 to 9 foot candles of light.

15. The auditorium lighting system of claim 2, wherein said power control system is positioned in an area separate from the plurality of LED light fixtures.

16. The auditorium lighting system of claim 13, wherein said power control system is positioned in an area separate from the plurality of LED light fixtures.

17. The auditorium lighting system of claim 2 wherein each ambient light LED module comprises a circuit board mounting a plurality of LEDs and wherein each high intensity light LED module comprises a circuit board mounting a plurality of LEDs and wherein each high intensity light LED module and each ambient light LED module are arranged linearly in the same row with the LEDs positioned to direct light into said auditorium.

18. The auditorium lighting system of claim 14 wherein each ambient light LED module comprises a circuit board mounting a plurality of LEDs and wherein each high intensity light LED module comprises a circuit board mounting a plurality of LEDs and wherein each high intensity light LED module and each ambient light LED module are arranged linearly in the same row with the LEDs positioned to direct light into said auditorium.

19. The auditorium house lighting system of claim 2 wherein said power control system is located in a projection booth of said auditorium.

* * * * *